US005585818A

United States Patent [19]

Shibamiya

[11] Patent Number: 5,585,818

[45] Date of Patent: Dec. 17, 1996

[54] DISPLAY CONTROL UNIT AND DISPLAY CONTROL METHOD

[75] Inventor: Yoshikazu Shibamiya, Tokyo, Japan

[73] Assignee: Canon Kabushiki Kaisha, Tokyo, Japan

[21] Appl. No.: 61,026

[22] Filed: May 14, 1993

[30] Foreign Application Priority Data

May 19, 1992 [JP] Japan ..... 4-126149

[51] Int. Cl.[6] ..... G09G 1/06

[52] U.S. Cl. ..... 345/112; 382/309

[58] Field of Search ..... 345/149, 150, 345/97, 213, 112; 382/50, 52; 358/455, 456

[56] References Cited

U.S. PATENT DOCUMENTS

| | | | |
|---|---|---|---|
| 5,119,084 | 6/1992 | Kawamura et al. | 345/213 |
| 5,243,443 | 9/1993 | Eschbach | 358/455 |
| 5,254,982 | 10/1993 | Feigenblatt et al. | 345/149 |
| 5,325,448 | 6/1994 | Katayama et al. | 382/50 |

FOREIGN PATENT DOCUMENTS 0378780 7/1990 European Pat. Off. ..... G09G 3/20

OTHER PUBLICATIONS

"Halftoning Method for Mosaic Color Displays Using Error Diffusion", IBM Technical Disclosure Bulletin, vol. 32, No. 5A, pp. 194–197 (Oct. 1989).

*Primary Examiner*—Kee M. Tung
*Assistant Examiner*—Doon Chow
*Attorney, Agent, or Firm*—Fitzpatrick, Cella, Harper & Scinto

[57] ABSTRACT

The present invention provides display control unit and method for binarizing data of an image to binary data by an error spared method while taking error data generated in binarizing previous images into consideration, and spreads error data generated in binarizing the current image to subsequent images to preserve a density of the input data and prevent moire and lumbrical noise, and provides a display control unit and method which spreads a binarizing error generated in binarizing an image to images to be subsequently binarized to preserve a density so that a high quality image having a high tonality and a high resolution is produced.

6 Claims, 4 Drawing Sheets

DISPLAY CONTROL UNIT AND DISPLAY CONTROL METHOD

BACKGROUND OF THE INVENTION

1. Field of the Invention

The present invention relates to display control unit and display control method, and more particularly to display control unit and display control method for quantizing input data to binary data or multi-value data and sending it to a display apparatus.

2. Related Background Art

A display apparatus is essential to an information processing apparatus for text and image, such as, word processor, personal computer or workstation.

Recently, as the information is distributed in multi-media and a processing performance of the information processing apparatus is improved, the display apparatus is required to display more information.

As a result, a display apparatus capable of not only monochromatic display but also gray level or full color animation display is required.

On the other hand, from the standpoint of cost reduction of the apparatus due to down-sizing and technology advancement and improvement of the office environment, the desk personalization of the information processing apparatus, that is, a trend of one unit per person is being enhanced, and from the standpoint of effective utilization of office space, reduction of the size and thickness of the apparatus is desired.

In the past, such a display apparatus would include a Braun tube display apparatus (CRT) and a liquid crystal display apparatus (LCD).

Of those, the former one, that is, the CRT, has a high display performance but is very expensive, and the latter one, that is, the LCD, includes several types which are generally thin but have some problems, respectively.

To achieve high display performance, a TFT liquid crystal display apparatus which has a drive element for each pixel is known. Since the drive elements are mounted on a surface of a liquid crystal glass, it has a low aperture factor and the display screen is dark. Further, the yield is low and a large size and fine screen is difficult to attain, and the cost is expensive. Accordingly, the TFT liquid crystal display apparatus is not yet common as a display apparatus for an information processing apparatus.

A simple matrix type STN liquid crystal apparatus which is primarily used presently is a binary display type and includes problems in display performance such as low contrast, cross-talk and a narrow viewing angle.

For a simple matrix type apparatus, a ferroelectric liquid crystal display apparatus (FLCD) which uses ferroelectric liquid crystal cells having a memory property is known. It does not have problems of contrast, viewing angle and cross-talk, but it can only make binary display at the present time.

When an image signal to be displayed is binarized, it will be very effective from the standpoint of improving the display performance if some image processing is performed to produce a quasi-gray level expression of an overall image to be displayed.

An error diffusion method which is a density reservation type binarizing method is known as a method for binary expression of the gray level. However, this method has the associated problems of reduction of resolution power, moire and lumbrical noise in the process of binarization. Further, since the prior art method is applied to a still image, no attention is paid to a continuously changing image such as animation, that is, an image which varies time sequentially and hence the moire and noise appear prominently.

SUMMARY OF THE INVENTION

It is an object of the present invention to provide a display control unit and method for displaying a high quality animation image on a display apparatus.

It is another object of the present invention to a provide display control unit and method for binarizing data of an image to binary data by an error spared method while taking error data generated in binarizing previous images into consideration, and spreads error data generated in binarizing the current image to subsequent images to preserve a density of the input data and prevent moire and lumbrical noise.

It is a further object of the present invention to provide a display control unit and method which spreads a binarizing error generated in binarizing an image to images to be subsequently binarized to preserve a density so that a high quality image having a high tonality and a high resolution is produced.

The above objects and other objects of the present invention will be apparent from the detailed description of the present invention made in conjunction with the accompanying drawings.

DESCRIPTION OF THE PREFERRED EMBODIMENTS

An embodiment of the present invention is now explained with reference to the drawings.

Figure 1:
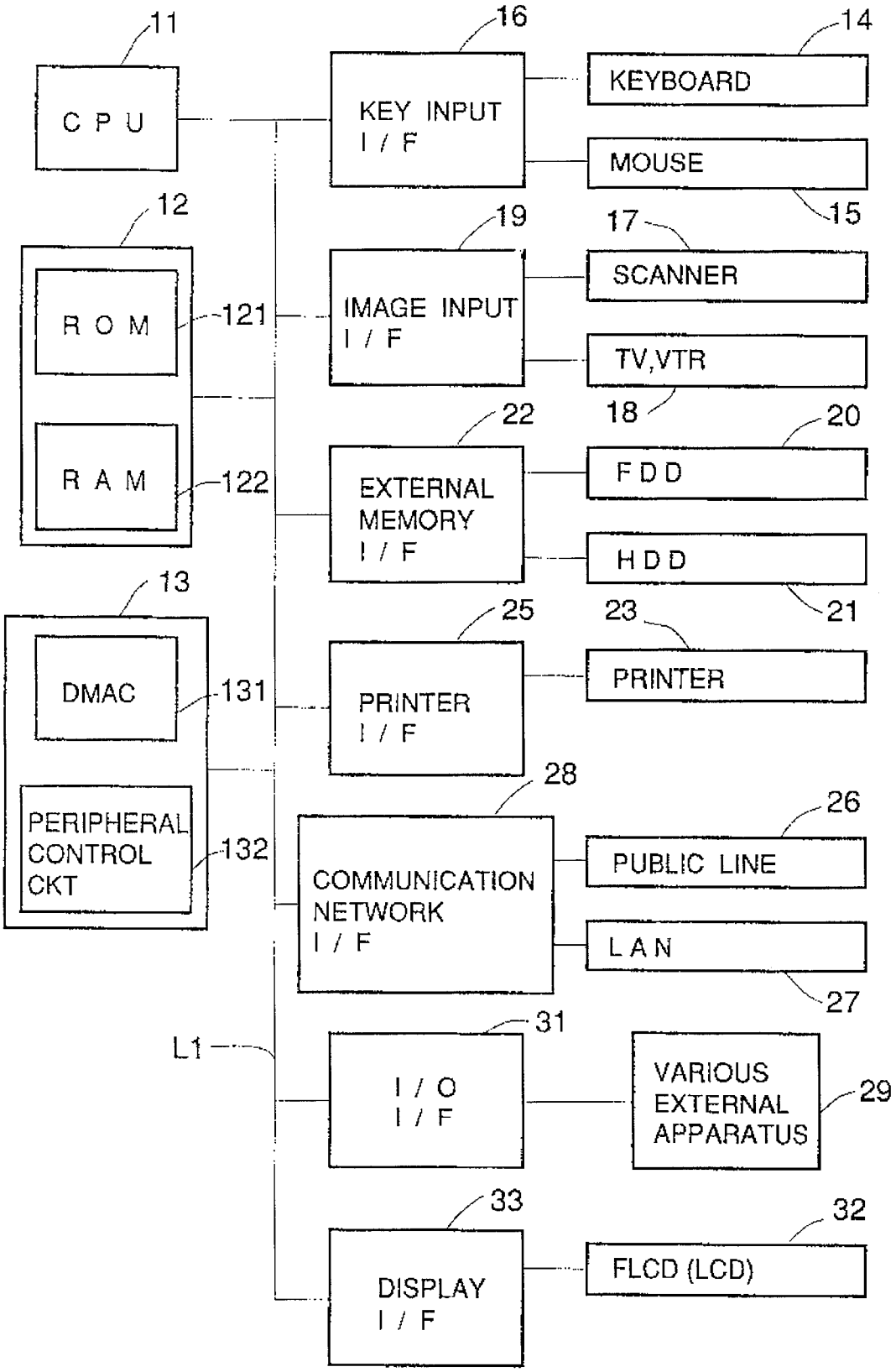
FIG. 1 shows a block diagram of a system configuration of the present invention.

FIG. 1 shows a system block diagram of one embodiment of the present invention.

In FIG. 1, numeral 11 denotes a processor or CPU which controls the entire system in accordance with a program and information from a memory and an interface to be described later.

Figure 4:
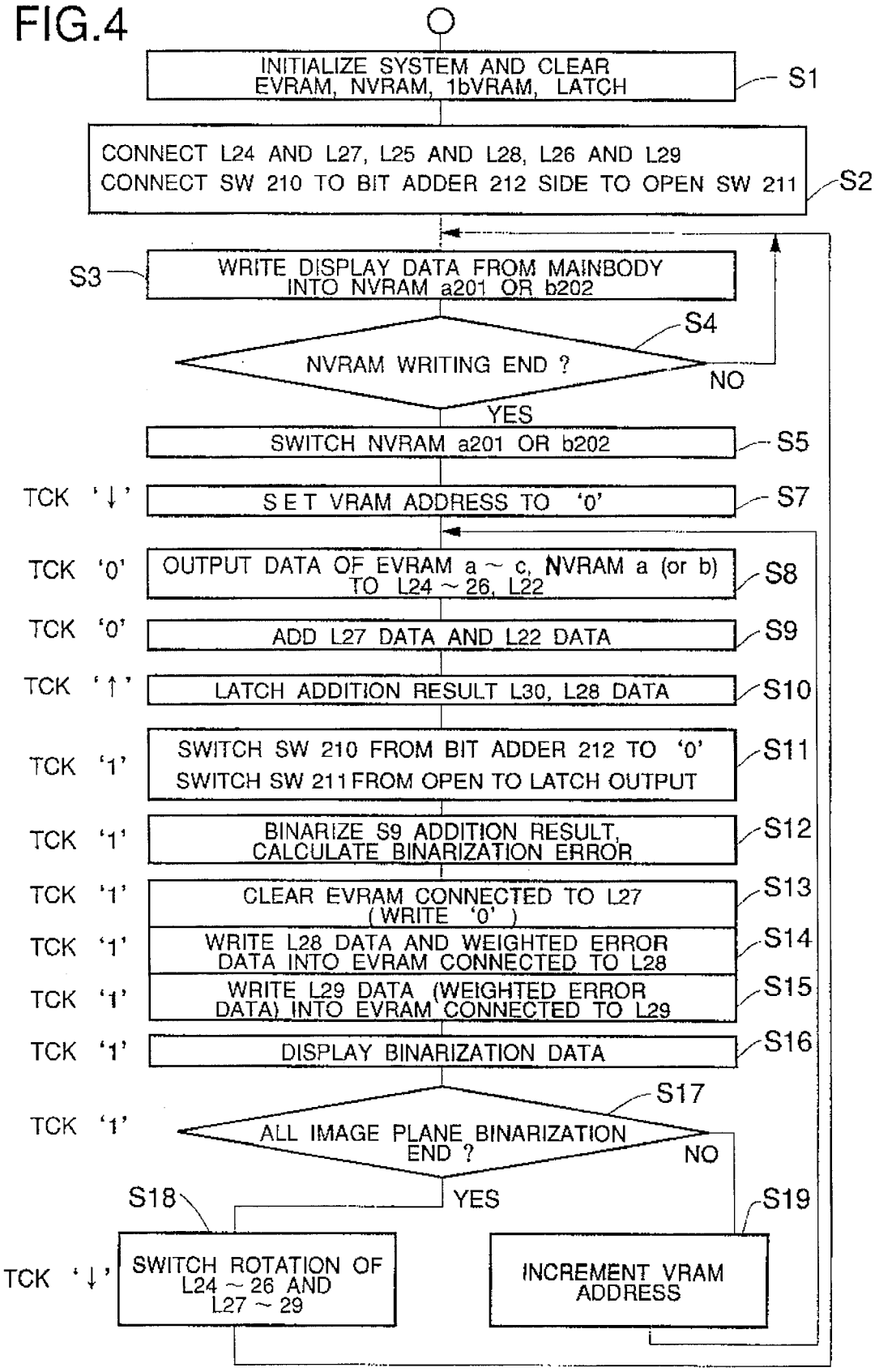
FIG. 4 shows a flow chart of a display operation in an embodiment of the present invention.

Numeral 12 denotes a main memory and numeral 121 denote a ROM (read-only memory) which stores a program to be executed by the CPU, a control program shown in FIG. 4 and initial settings required for the processing. In addition to the program stored in the ROM, a program from an external memory interface may be written into a RAM to execute it. Numeral 122 denotes a RAM (rewritable memory) which is used as a work area to temporarily store programs to be executed by the CPU 11 and various data during the execution.

Numeral 13 denote a CPU peripheral control circuit which comprises a DMAC (direct memory access controller) 131 which conducts data transfer with the main memory and between the main memory 12 and various units of the present invention without routing the CPU 11, and a peripheral control circuit 132 for controlling the main memory 12 and various interruptions.

Numeral 14 denotes a keyboard for entering character information and control information, numeral 15 denotes a mouse which serves as a pointing apparatus, and numeral 16 denotes a key input interface for controlling the keyboard 14 and the mouse 15 and connecting signals from those devices to the system.

Numeral 17 denotes a scanner for inputting a still image into the system, numeral 18 denotes a video apparatus such as a television or VTR for generating a video signal of image information such as animation or still image, and numeral 19 denotes an image input interface for controlling the scanner 17 and the video apparatus 18 and inputting signals from those devices to the system.

Numerals 20 and 21 denote a floppy disk drive and a hard disk drive, respectively, which serve as external storage, and numeral 22 denotes an external storage interface for controlling the external storage apparatuses and connecting the signals thereof to the system.

Numeral 23 denotes a printer apparatus such as a laser beam printer or an ink jet printer which serves as an output apparatus, and numeral 25 denotes a printer interface for controlling the printer 23 and connecting the signals therefrom to the system.

Numeral 26 denotes a public communication line such as a telephone line, numeral 27 denotes a LAN (local area network) such as Eathernet, and numeral 28 denotes a communication network interface for connecting the telephone line 26 and the LAN 27 to the system.

Numeral 29 denotes an other input/output apparatus, and numeral 31 denotes an I/O interface for connecting the input/output apparatus 29 to the system.

Numeral 32 denotes a display apparatus such as FLCD or LCD. In the present system, it is a monochromatic binary display apparatus having P×Q pixels (P horizontal pixels and Q vertical pixels).

Numeral 33 denotes a display apparatus interface for displaying the signal from the system as an image on the display 32.

L1 denote a system bus comprising an address bus, a data bus and a control bus for connecting signals between the apparatuses and controlling them.

Display information inputted by the display interface 33 has a data length of 8 bits per pixel to express 0 to $(2^8-1)$ gray levels. Accordingly, the display interface 33 converts the 8 bits/pixel data to 1 bit/pixel binary data and sends it to the FLCD 32.

The 8 bits/pixel display information is processed by the CPU 11 based on the text, image and control information from the keyboard 14, the mouse 15, the scanner 17, the video apparatus 18, the floppy disk drive 20, the hard disk drive 21, the public line 26 and the network 27, or directly by the DMAC 131 and sent to the display interface 33 through L1 as the 8 bits pixel data.

Figure 2:
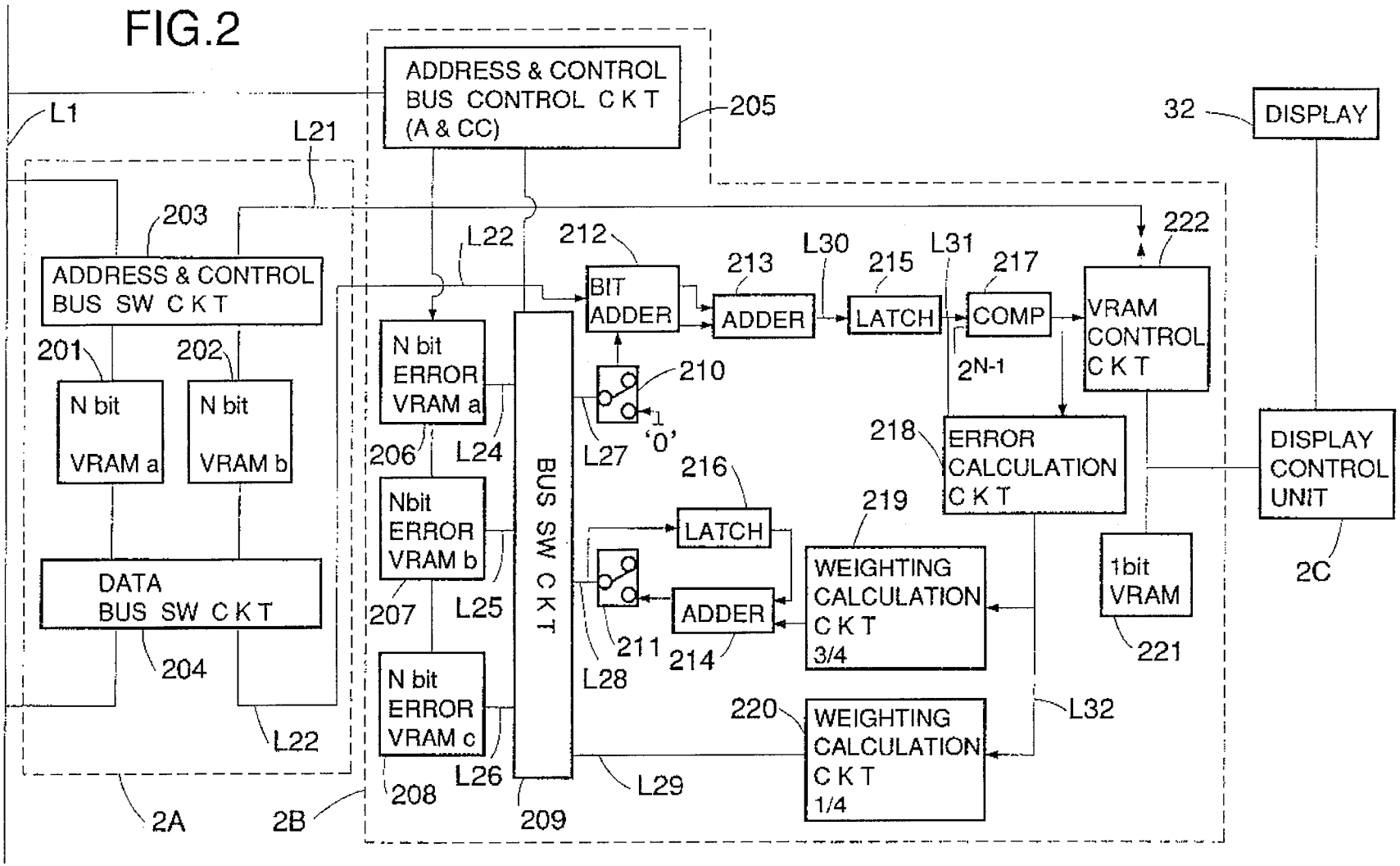
FIG. 2 shows a block diagram of detail of a display apparatus interface 33 of FIG. 1.

FIG. 2 shows a block diagram of details of the display interface 33.

As shown, the interface comprises, in major part, a display RAM 2A, a binarization control unit 2B and a display control unit 2C.

Numerals 201 and 202 denote RAM's (NVRAM's), that is, NVRAMa and NVRAMb for storing one screen of 8 bits/pixel display data and they are configured as a bit map RAM which is one-to-one associated with the pixels of the display. One of the pair of NVRAM's is connected to the L1 system bus to write the display data from the system. The other NVRAM is connected to the buses L21 and L22 which are connected to the binarization control unit 2B and is used for the transfer of display data to the binarization control circuit.

The pair of NVRAM's are appropriately switched by the control from the system bus L1 from the system, and an address and control bus control circuit 205 to be described later.

Numerals 203 and 204 denote an address and control bus switching circuit and a data bus switching circuit, respectively, for selectively connecting the NVRAMa and the NVRAMb to the system bus L1 and the binarization control unit buses L21 and L22.

L21 and L22 denotes address control bus and a data bus, respectively, in the binarization control unit 2B.

The data bus L22 is an 8-bit display data bus for expressing 0 to $(2^8-1)$ gray levels.

Numeral 205 denotes an address and control bus control circuit (A&CC) which generates read/write addresses of an error VRAM and a 1-bit VRAM to be described later, controls the switching of the buses of the binarizing control circuit and supplies timing.

Numeral 206, 207 and 208 denote 8-bit length error bit map RAM's (EVRAM's), namely, EVRAMa, EVRAMb and EVRAMc for storing errors (binarization errors) created when the 8-bit display information is binarized to "1" and "0" binary information.

The binarization error data is in a range of 0 to $\pm(2^{8-1}-1)$, and a negative number is expressed by a 2's complement. When a signal having a signal level of $0 \leqq u \leqq 1$ is binarized to "0" or "1", an error of u or (u−1) is created. This is called a binarization error.

L24, L25 and L26 denote 8-bit data buses for the EVRAMa 206, EVRAMb 207 and EVRAMc 208, respectively.

Numeral 209 denotes a bus switch which rotationally switches the connection of the data buses L24, L25 and L26 with 8-bit data buses L27, L28 and L29, respectively, by a control signal from the A&CC 205.

Numerals 210 and 211 also denote bus switches which switch the buses as shown in FIG. 2 by the control signal from the A&CC 205, as the bus switch circuit 209 does.

Numeral 212 denotes a bit adder which converts 8-bit display data without sign and 8-bit binarization error data with sign sent from the data switch 204 through the data bus L22 to 9-bit data with sign.

Numerals 213 and 214 each denote 2-input adders, and numerals 215 and 216 each denote an edge hold type latch circuit which is controlled by a timing signal (TCK signal of FIG. 3 to be described later) supplied from the A&CC 205. It is sampled at a rising edge of the timing signal.

L31 denotes 9-bit display data derived from the sum of the adder 213 through the latch 215. It is the display data for the binarization.

Numeral 217 denote a comparator which compares the 9-bit display data sent from the latch 215 through the data bus L31 with a fixed value $2^{8-1}$, and outputs "0" if (display data)$<2^{8-1}$, and outputs "1" if $2^8+2^{8-1}>$(display data)$\geqq 2^{8-1}$.

Numeral 218 denotes an error calculation circuit which calculates the 8-bit binarization error with sign based on the output from the latch 215 and the comparison output from the comparator 217 and supplies it to L32.

Numerals 219 and 220 each denote a weighting circuit for 8-bit with sign which weights ¼ and ¾, respectively, to error data from the error calculation circuit 218.

Numeral 221 denotes a bit map video RAM (lbVRAM) for storing the binarized display information.

Numeral 222 denotes a VRAM control circuit (lbVRAMC) for writing output data from the comparator 217 to the lbVRAM 221, transferring the binary display data to a display control circuit 2C to be described later, and arbitrating them.

Numeral 2C denotes a display control circuit which receives a display request signal from the display 32 to read the display data from the lbVRAM 221 and transfer it to the display 32.

Figure 3:
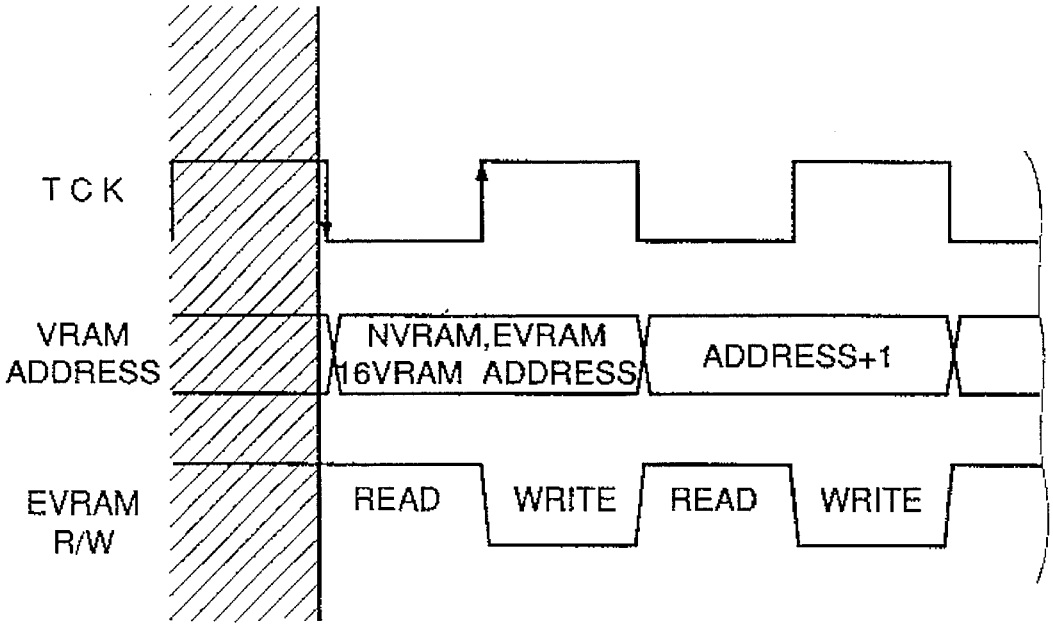
FIG. 3 show a time chart of signals used in the display apparatus interface.

FIG. 3 is now explained.

FIG. 3 shows a timing of data signals in the address control bus L21.

TCK is a basic clock for the operation of the binarization control unit 2B. Other signals and the buses are operated with reference thereto.

VRAM address is one for accessing the NVRAMa 201 (or NVRAMb 202), the EVRAMa 206 to EVRAMc 208 and the lbVRAM 221.

EVRAM R/W is a control signal for controlling the reading of data from the EVRAMa 206 to EVRAMc 208 and the writing of data to the EVRAMa 206 to EVRAMc 208. It reads with a logical level "1" and writes with "0".

An operation of the present invention is now explained in connection with the display interface of the present invention with reference to the address bus signal generated by A&CC and the timing signal of FIG. 3 and the flow chart of FIG. 4.

After the start-up of the system and before the start of the display operation, the contents of the NVRAMa 201 to NVRAMb 202, the EVRAMa 206 to EVRAMc 208, the lbVRAM 221 and the latches 215 and 216 are initialized and cleared (to "0") by the CPU (S1 in FIG. 4).

Then, the bus switching circuit 209 connects the data bus L24 with the data bus L27, the data bus L25 with the data bus L28, and the data bus L26 with the data bus L29, and throws SW 210 to the bit adder 212 and opens SW 211 (S2 in FIG. 4).

As described above, the 8-bit display data of the system is sent to the display interface 33 through the system bus L1 as the 8-bit pixel data.

The NVRAMa 201 and NVRAMb 202 are, on one hand, connected to the system bus L1 of the system by the control data from the system bus L1 and the A&CC 205, and on the other hand, connected to the binarization control circuit 2B, and the transferred display data is written into the NVRAMa 201 or NVRAMb 202 connected to the system bus L1 (S3 in FIG. 4).

On the other hand, the A&CC monitors the system bus L1 and the binarization control bus L21 (S4 in FIG. 4), and when the system completes the writing of the display image pixels (one display screen) to the NVRAMa 201 or NVRAMb 202, it switches the connection of the NVRAMa 201 or NVRAMb 202 (S5 in FIG. 4). After the switching, new 8-bit data from the system bus L1 is written into the other NVRAM.

Thus, the operation of the binarization control unit 2B is stated.

First, the VRAM address is set to "0", and as shown in FIG. 3, the address set in the address control bus L21 is read at the rise of TCK (S7 in FIG. 4).

When TCK changes to "0" level, the 8-bit display data written in the NVRAMa 201 or NVRAMb 202 from the system is read and supplied to L22. The binarization error data is read from the EVRAMa 206 to EVRAMc 208 are read and supplied to the corresponding buses L24 to L26, respectively. The binarization error data of the EVRAMa 206 on L24 is supplied, by the bus switching circuit 209, to the bit adder 212 through L27 and SW 210. On the other hand, the binarization error data of the EVRAMb 207 on L25 is supplied, by the bus switching circuit 209, to the latch 216 through L28 (S8 in FIG. 4).

The 8-bit display data on L22 and the binarization error data on L24 are supplied to the bit adder 212 where they are converted to 9-bit data and summed by the adder 213, and the sum is supplied to the latch 215 through L30 (S9 in FIG. 4).

At the rise of TCK, the latch 215 latches and the sum of the 8-bit display data on L22 and the binarization error data on L24 is supplied to L3. Further, the latch 216 latches and the binarization error data of the EVRAMb 207 is supplied to the adder (S10 in FIG. 4).

When TCK change to "1" level, the EVRAM R/W signal which indicates the reading and writing of data from and to the EVRAMa 206 to EVRAMc 208 is changed from "1" to "0" to switch control from the reading to writing, and the connection of L27 of SW 210 is changed from the bit adder 212 to "0", and the connection of L28 of SW 211 is changed from the open state to the output of the adder 214 (S11 in FIG. 4). At the same time, the 9-bit data on L31 is compared with the threshold $2^{8-1}$ by the comparator 217, and it is binarized to either "0" or "1" depending on the comparison result. The error calculation circuit 218 operates based on the result to supply the binarization error data of 8 bits with sign to L32 (S12 in FIG. 4).

"0" is supplied to L24 through SW 219, L27 and the bus switch 210, and it is written into the EVRAMa 206 (S13 in FIG. 4). That is, the data of the EVRAMa 206 is cleared.

The output of the latch 216, that is, the binarization error signal written in the EVRAMb 207 and the binarization error data of 8 bits with sign which is weighted by a factor of ¾ by the weighing circuit 219 is summed by the adder 214, and the sum is supplied to L25 through SW 211, L28 and the bus switch 209 and is written into the EVRAMb 207 (S14 in FIG. 4).

The binarization error data of 8 bits with sign which is weighted by a factor of ¼ by the weighing circuit 220 is supplied to L26 through L29 and the bus switch 209, and it is written into the EVRAMc 208 (S15 in FIG. 4).

On the other hand, the 1-bit display data binarized by the comparator 217 is controlled by the lbVRAM 222 and written into the lbVRAM 221 and displayed on the display 32 by the display control circuit 2C (S16 in FIG. 4).

The A&CC 205 monitors whether the VRAM address has reached the total display pixel number, that is, whether one screen of data has been binarized and displayed (S17 in FIG. 4), and if it does not reach this number, it increments the VRAM address (S19 in FIG. 4) and the process returns to S8 to repeat the above steps until the VRAM address reaches the total display pixel number, when the binarization and display of one screen of display data are completed.

The contents of the EVRAM's at this moment, that is at the end of the binarization of the first screen are all-"0" for the EVRAMa 206, ¾ of the binarization error of the first screen for the EVRAMb 207, and ¼ of the binarization error of the first screen for the EVRAMc 208.

When the VRAM address reaches the total display pixel number, the A&CC 205 controls the bus switching circuit 209 to move the top EVRAMa 206 to the bottom in FIG. 2 and to move up the EVRAMb 207 and EVRAMc 208. Namely, L25 is connected to L27, L26 is connected to L28, and L24 is connected to L29 (S18 in FIG. 4). Then, the process returns to S3 of FIG. 4 to write the display data of the second screen from the system to the NVRAM, and when the end of writing is detected, S4 to S19 of FIG. 4 are repeated.

Since L25 is connected to L27, the display data on L31 for the binarization of the second screen is the sum of the display data of the NVRAMb 202 (or NVRAMa 201) of the second screen and the content of the EVRAMb 207 (¾ of the binarization error of the first screen).

Namely, (the display data (L31) for binarization of the second screen)
=(display data of the second screen)
+(binarization error data of the first screen)×¾

The contents of the EVRAM's at the end of the binarization of the second screen are all-"0" for the EVRAMb 207, (binarization error data of the first screen)×¼+(binarization error data of the second screen)×¾ for the EVRAMc 208, and (binarization error data of the second screen)×¾ for the EVRAMa 206.

When the VRAM address reaches the total display pixel number and the process for the second screen is completed, the bus switching circuit 209 switches to connect L26 to L27, L24 to L28 and L25 to L29 as it does in the switching for the first screen, and starts the binarization for the third screen.

By repeating the above steps, the display data for the binarization of the M-th screen at time $t_M$
=(display data of M-th screen)
+(binarization error data of (M−1)th screen)×¾
+(binarization error data of (M−2)th screen)×¾

The contents of the three EVRAM's at the end of the binarization of the M-th screen are:
(1) all-"0"
(2) (binarization error data of (M−1)th screen)×¼
+(binarization error data of M-th screen)×¾
(3) (binarization error data of M-th screen)×¼

Accordingly, when the data of the M-th screen is binarized, the binarization error data of the (M−1)th and (M−2)th screens at times $t_{M-1}$ and $t_{M-2}$ are spread. The binarization error generated when the data of the M-th screen is binarized at $t_M$ is spread up to the (M+1) th and (M+2) th screens at $t_{M+1}$ and $t_{M+2}$.

In accordance with the present invention, when data of one screen is converted to binary data by the error diffusion method, binarization is conducted by taking the error data generated in the binarization of the previous screens into consideration, and the error data generated in the binarization of the current screen is spread to subsequent screens. Accordingly, the density of the input data is preserved and the moire and the lumbrical noise are prevented, and high quality display image is attained. When the binarization error is corrected in one screen, the tonality is improved but the resolution power is lowered. In accordance with the present invention, however, since the binarization error is spread to a plurality of screens to be subsequently processed and the density is preserved, the tonality is excellent and the resolution is improved.

While the display is LCD in the above embodiment, it may be a CRT display.

While the binarization error is spread up to two subsequent screens in the above embodiment, it may be spread to one subsequent screen or three or more subsequent screens.

The weighing factors may be other than ¼ and ¾.

While the data and the error data are simply summed in the above embodiment, they may be processed in another way.

While the input data in monochrome in the above embodiment, three-color R, G, B input data may be processed respectively to attain color display. This may be attained by providing the circuit shown in FIG. 2 to each of the R, G, B input data.

The LCD display apparatus is not limited to the ferroelectric liquid crystal display apparatus but it may be a TFT liquid crystal display apparatus.

The gray level processing applicable to the present invention is not limited to the error diffusion method but a mean error minimizing method or mean density preservation method may be used. A method including the step of correcting an error generated when the input data is quantized may be used.

While the input data is converted to binary data in the above embodiment, where the LCD or the CRT is capable of displaying multi-level tonality of no smaller than 2, the input data may be quantized to multi-level data displayable by the LCD or the CRT and error data generated in quantizing may be spread to the data of subsequent screens.

What is claimed is:

1. A display control unit comprising:

quantizing means for quantizing image data of a screen inputted at a time t;

calculation means for calculating error data generated by said quantizing means;

data transfer means for sending data quantized by said quantizing means to a display apparatus; and storage means for storing error data calculated by said calculation means, wherein said quantizing means quantizes image data of an M-th screen at a first time $t_M$, and said quantizing means quantizes image data of an (M+1)th screen inputted at a second time $t_{(M+1)}$ using error data calculated by said calculation means in accordance with quantized image data for the M-th screen quantized by said quantizing means at time $t_M$ and stored in said storage means.

2. A display control unit according to claim 1, wherein said quantizing means quantizes image data to binary data or multi-level data, and said calculation means calculates a difference between the input image data and the binary data or multi-level data.

3. A display control unit according to claim 1, wherein said storage means includes a first memory for storing error data to be spread into input image data of the (M+1)th screen inputted at the second time $t_{(M+1)}$, and a second memory for storing error data to be spread into input image data of an (M+2)th screen inputted at a third time $t_{(M+2)}$.

4. A display control unit according to claim 1, wherein said display apparatus is a ferroelectric liquid crystal display apparatus.

5. A display control unit for converting input multi-level pixel data to binary pixel data, comprising:

binarization means for binarizing data;

binarization error calculation means for calculating binarization error data generated by said binarization means in binarizing multi-level pixel data for a screen of a display;

binarization error storage means for storing binarization error data calculated by said binarization error calculating means; and data operation means for operating on input multi-level pixel data of an M-th screen and binarization error data generated by said binarization error calculating means, wherein said data operation means operates on input multi-level pixel data of the M-th screen based on binarization error data calculated in accordance with binarization of multi-level pixel data for at least an (M−1)th screen stored in said binarization error storage means.

6. A display control method for converting input multi-level pixel data to binary pixel data, comprising the steps of:

calculating a binarization error generated in binarizing multi-level pixel data;

storing a binarization error calculated in said calculating step in binarization error storage means;

operating on input multi-level pixel data of an M-th screen of a display based on error data generated in said calculating step for input multi-level pixel data for at least an (M−1)th screen of the display and stored in said binarization error storage means; and binarizing data generated in said operating step.

* * * * *

UNITED STATES PATENT AND TRADEMARK OFFICE

CERTIFICATE OF CORRECTION

PATENT NO. : 5,585,818

DATED : December 17, 1996

INVENTOR(S) : YOSHIKAZU SHIBAMIYA

It is certified that error appears in the above-identified patent and that said Letters Patent is hereby corrected as shown below:

AT [57] ABSTRACT

Line 1, "provides" should read --provides a--.

COLUMN 1

Line 1, "display" should read --a display--.
Line 2, "display" (both occurrences) should read --a display--.
Line 3, "display" should read --a display--.

COLUMN 2

Line 13, "a provide" should read --provide a--.
Line 17, "spreads" should read --to spread--.
Line 54, "denote" should read --denotes--.

COLUMN 4

Line 16, "denotes" should read --denote--.
Line 26, "Numeral" should read --Numerals--.

COLUMN 5

Line 8, "221," should read --221, for--.
Line 10, "arbitrating" should read --for arbitrating--.

UNITED STATES PATENT AND TRADEMARK OFFICE

CERTIFICATE OF CORRECTION

PATENT NO. : 5,585,818

DATED : December 17, 1996

INVENTOR(S) : YOSHIKAZU SHIBAMIYA

It is certified that error appears in the above-identified patent and that said Letters Patent is hereby corrected as shown below:

COLUMN 6

Line 24, "the" should be deleted.

Signed and Sealed this

Nineteenth Day of August, 1997

Bruce Lehman

*Attest:*

BRUCE LEHMAN

*Attesting Officer*

*Commissioner of Patents and Trademarks*